United States Patent [19]

Manea

[11] 4,076,049

[45] Feb. 28, 1978

[54] MACHINE FOR THE FORMATION OF SELVEDGES IN FABRICS

[75] Inventor: Antonio Manea, Schio (Vicenza), Italy

[73] Assignee: F.11i Manea S.n.c. Costruzioni Meccaniche Accessori Tessili, Schio (Vicenza), Italy

[21] Appl. No.: 677,484

[22] Filed: Apr. 15, 1976

[30] Foreign Application Priority Data

| | | |
|---|---|---|
| Apr. 16, 1975 | Italy | 22411/75 |
| Oct. 3, 1975 | Italy | 27937/75 |

[51] Int. Cl.[2] ..... D03D 47/48

[52] U.S. Cl. ..... 139/434; 139/194

[58] Field of Search ..... 139/430, 434, 194

[56] References Cited

U.S. PATENT DOCUMENTS

| | | | |
|---|---|---|---|
| 3,425,461 | 2/1969 | Berry | 139/434 |
| 3,563,280 | 2/1971 | Cugini | 139/434 |
| 3,951,177 | 4/1976 | Santucci | 139/434 |

*Primary Examiner*—Henry S. Jaudon

*Attorney, Agent, or Firm*—Karl W. Flocks

[57] ABSTRACT

A machine for forming the so-called tucked selvedge is disclosed, which comprises two thread-grasping units, a thread cutting unit and a movable hook-needle. The second thread-grasping unit is laterally shifted relative to the first like mechanism. The hook-needle serves to grasp the weft thread and to insert it in the warp shed as this becomes available. The working sequence of all of these mechanical units is warranted by appropriate, specially provided cam and linkage mechanisms. The advantage is that thread waste for the formation of a dummy selvedge is prevented.

3 Claims, 13 Drawing Figures

MACHINE FOR THE FORMATION OF SELVEDGES IN FABRICS

This invention relates to a machine which is adapted to form a so-called tucked selvedge in a fabric woven by means of a shuttle-less loom.

As is well known to those skilled in this field, one of the most prominent technical problems to be solved for making a tucked selvedge in a fabric produced by a shuttle-less loom is that of the manner in which to support the weft threads introduced in the shed in such a condition as to permit their being severed by means of an appropriate device.

To this purpose, it is already known to make a dummy selvedge, which is properly spaced apart from the fabric being woven, which selvedge has just the specific purpose of maintaining taut the weft threads inserted in the warp shed. A severing device cuts the threads of the weft, the end shank of which is immediately grasped by a needle which causes it to re-enter, folded, in the subsequent shed which is closed thereover and thus the selvedge proper is formed.

The defect of such a procedure is that a not negligible amount of thread is wasted for making the dummy selvedge, which is lost.

Apparatus have already been suggested in order to redress this drawback, these being equipped with suction means which are capable of conveying the weft threads under a taut condition to a point where they are cut.

These apparatuses, however, are costly, both as regards their manufacture and their installation.

Another considerable defect exhibited by the conventional machines is seen when more fabrics are woven on a single loom. In this case apparatuses are to be installed for the formation of the selvedge, also centrally with respect to the loom. As a result, in the loom reed appropriate openings are to be formed to permit its closing against the template; this is because in the conventional machines the reed itself, at the closing, carries the weft in correspondence with the apparatus, which, obviously, to grasp the weft threads, shall be arranged in advance relative to the template.

The openings as formed in the reed thus serve to permit the passage of the reed through the machines which are arranged centrally of the loom.

Under these conditions, for every fabric width, there must be arranged a special comb, with an apparent additional expenditure.

An object of the present invention is to do away with the drawbacks enumerated above of the conventional art and, to this purpose, it has been envisaged to provide a machine for the formation of a tucked selvedge in a fabric produced on a shuttle-less loom, the machine being characterized in that it comprises, in combination:

a first movable thread-seizing device adapted to grasp a weft thread inserted in the warp shed and to carry it into engagement with at least a second thread-seizing device which is laterally displaced relative to the first, a thread-cutting device arranged between said two thread-seizing devices and adapted to sever the weft thread at a point of its shank which is taut between the two thread-seizing devices, and a hook needle movable for seizing the weft thread which has been cut and to have it entering the open warp shed again which is closed thereon; actuating mechanisms being provided which are capable of moving in the correct operative sequence said two thread-seizing devices, said cutting device and said hook needle.

A practical embodiment of the present invention will now be described hereinafter by way of example only, reference being had to the accompanying drawings, wherein.

FIGS. from 6 to 8 are cross-sectional views which illustrate different working conditions of the machine.

Figures 1, 9:
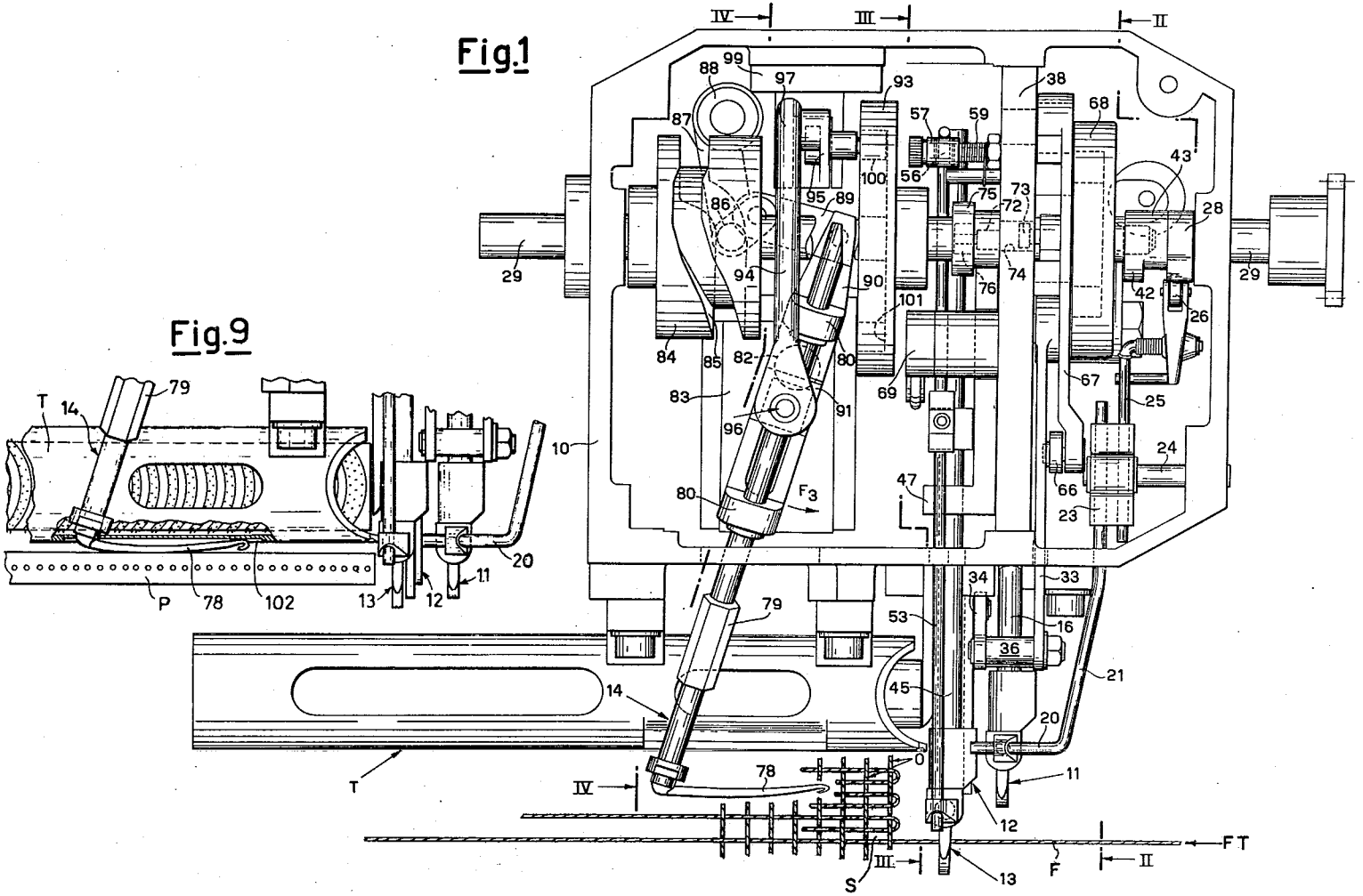
FIG. 1 is a plan view of a machine for the formation of tucked selvedge in fabrics, constructed according to the invention and with the lid removed so as to show the mechanisms composing the machine.

FIG. 9 is a closeup view showing another working condition of the machine.

Figure 10:
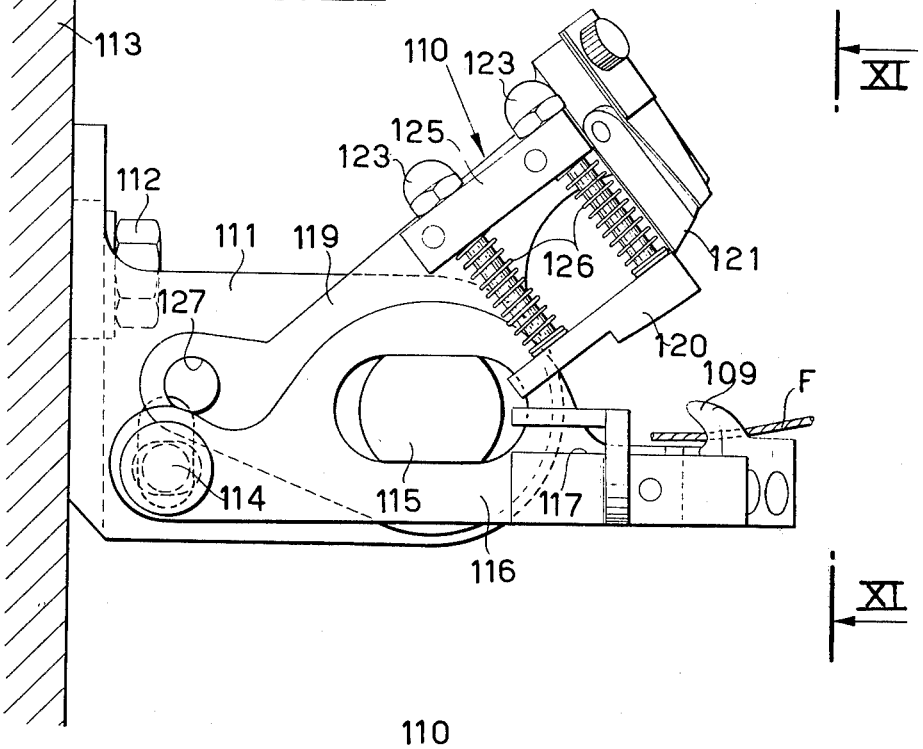

FIG. 10 is a side elevational view showing a possible modification of the machine shown in FIGURES from 1 to 9.

Figure 11:
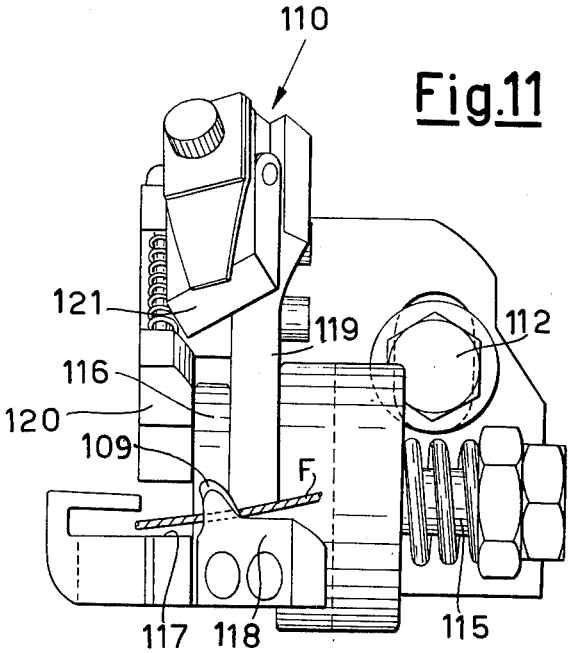
Figure 12:
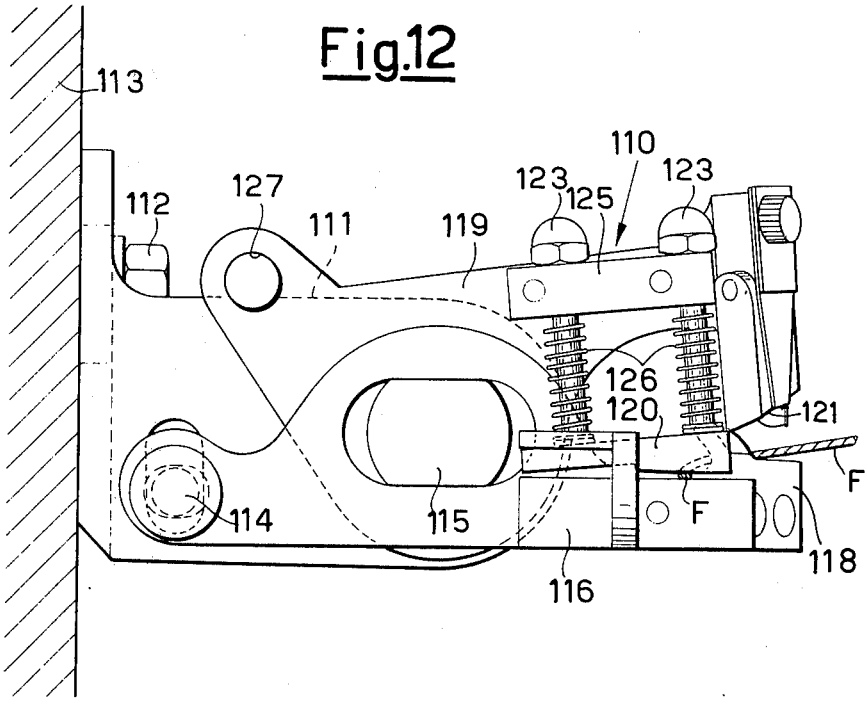
Figure 13:
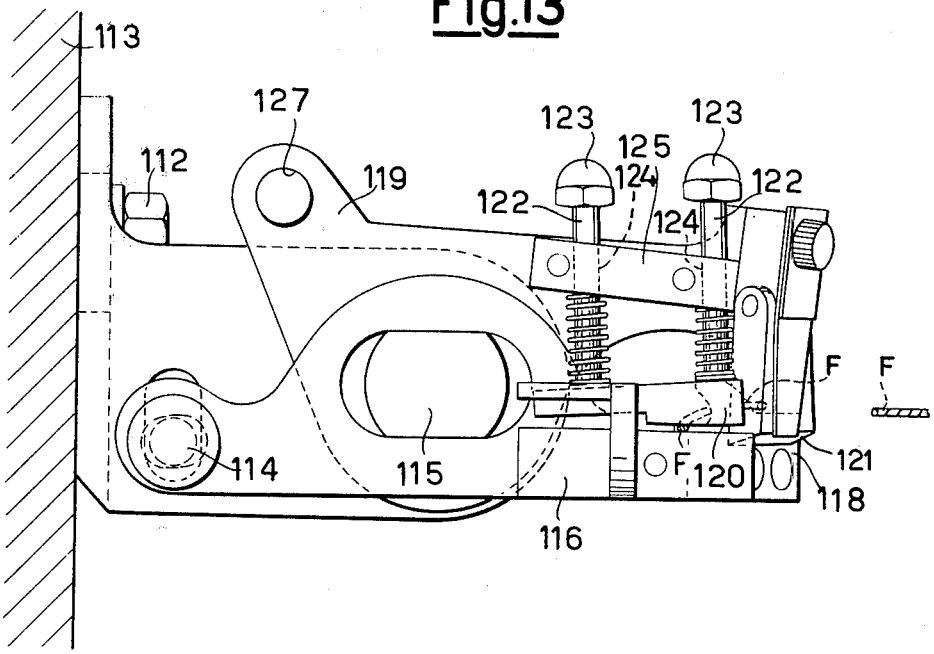

FIG. 11 is a front elevational view taken along the line XI—XI of FIG. 10, and FIGS. 12 and 13 are two views similar to that of FIG. 10, but showing said modification in its two different working conditions.

Figure 2:
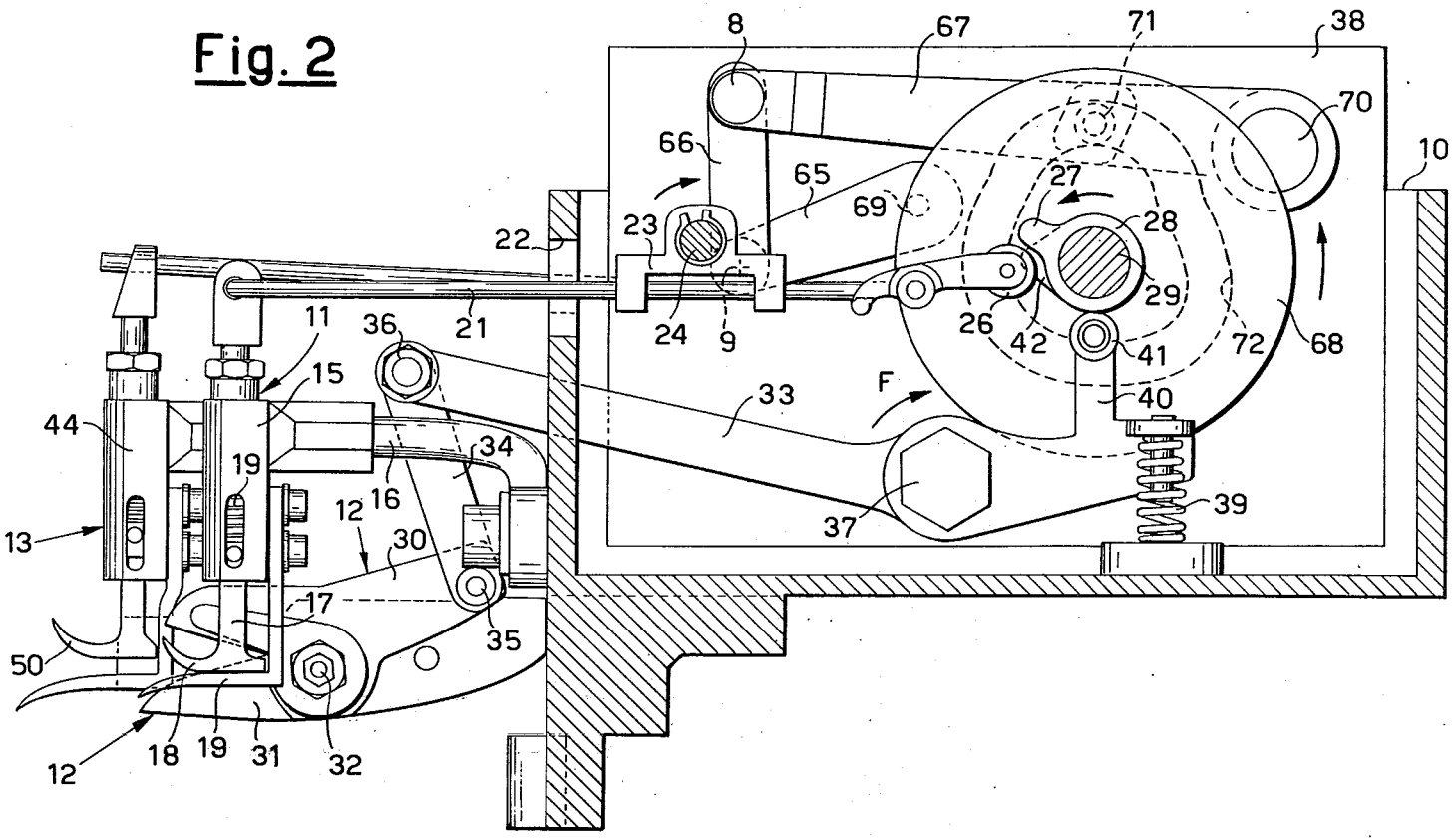
FIG. 2 is a cross-sectional view taken along the line II—II of FIG. 1.
Figure 3:
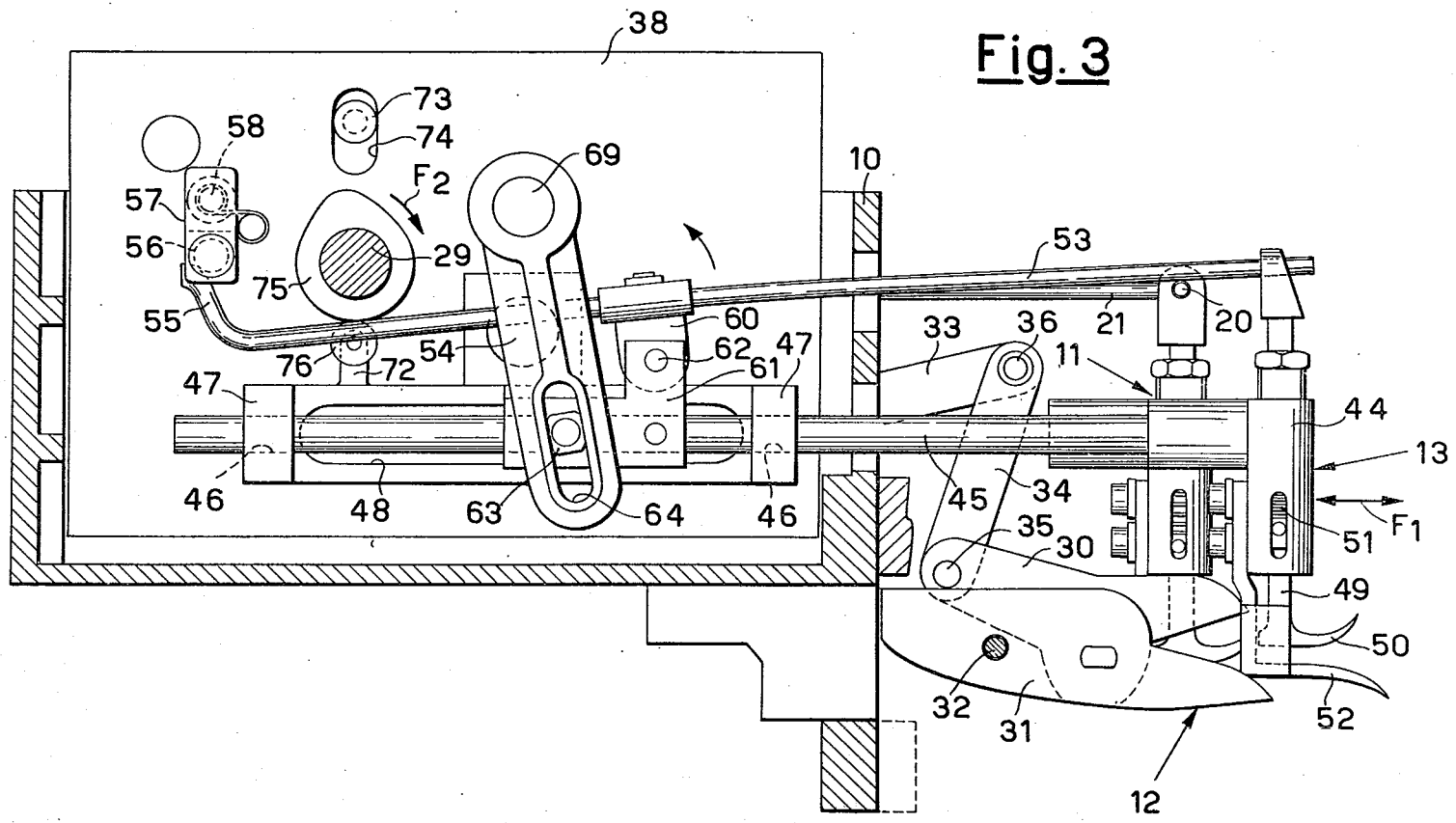
FIG. 3 is a cross-sectional view taken along the line III—III of FIG. 1.
Figure 4:
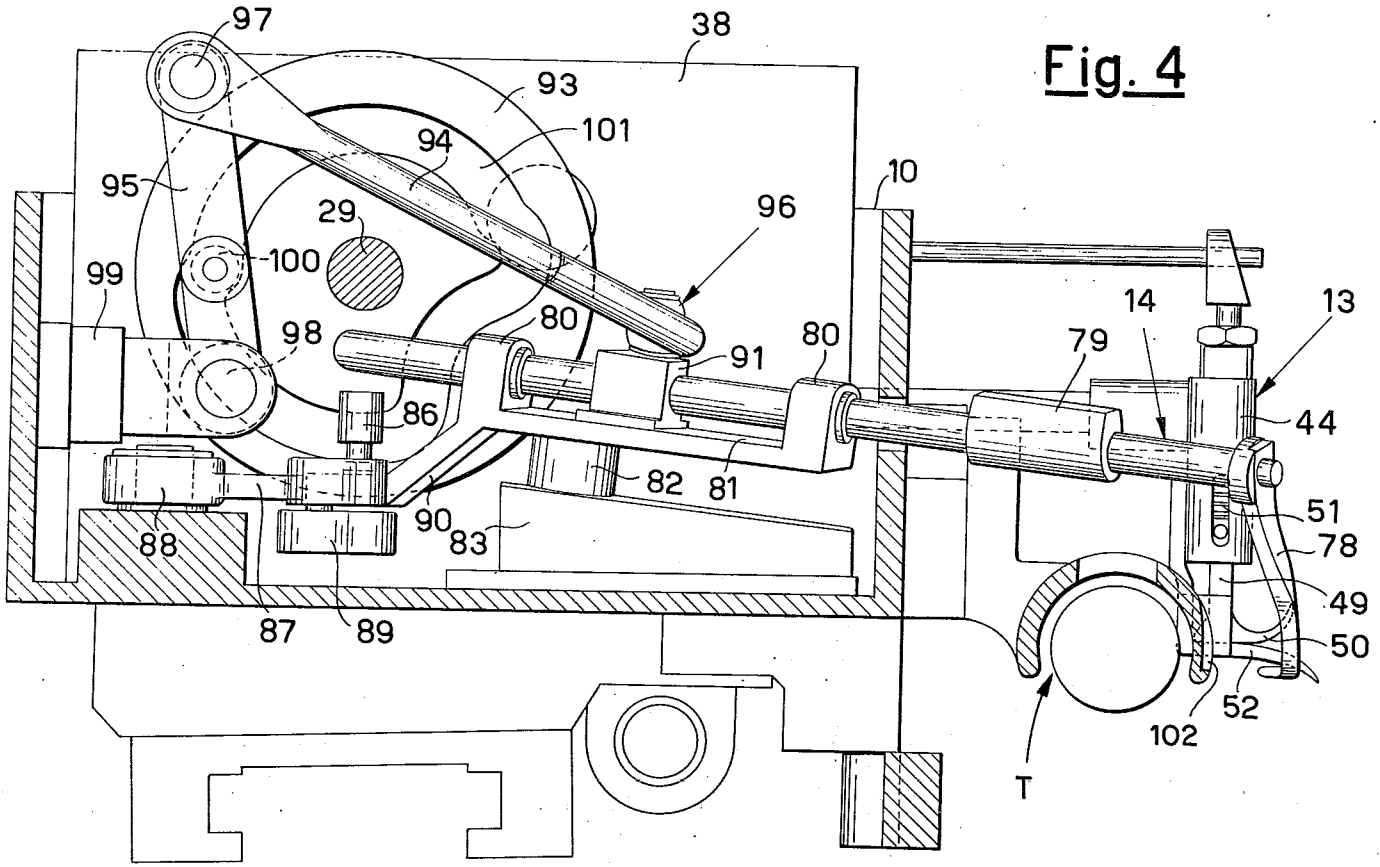
FIG. 4 is a cross-sectional view taken along the line IV—IV of FIG. 1.

Having now reference, at the outset, to FIG. 1 of the drawings, the machine for the formation of tucked selvedges as constructed according to the present invention, is structurally made up by a framing 10 in which all the actuation mechanisms are housed of four operative units 11, 12, 13 and 14 which are extended towards the outside of the framing and constitute the essential embodiments of the present invention (FIGS. 2, 3 and 4). More exactly, the unit 11 comprises a first thread-seizing device, or pincer, the unit 12 comprises a thread-cutting device, the unit 13 comprises a second thread-seizing device, and the unit 14 comprises a thread-conveying device.

The first thread-seizing device or pincer 11 is composed by a tubular guide 15 as supported by means of an arm 16 which is overhangingly extended from the framing 10. Within the guide 15 there is controlled for vertical sliding the stem 17 of a movable foot 18. A spring 19 urges in a manner known per se the foot 18 into engagement with a fixed abutment 19 fastened to the guide 15. To the end of the stem 17 opposite to the foot 18 is idly fastened the curled end 20 of a rod 21, the latter emerging from the framing 10 through an opening 22. The opposite end of the rod 21 is fastened to a junction member 23 which is rotatable about a pin 24, the latter being extended from a sidewall of the framing 10. To the same junction member 23 is fastened an extension 25 of the rod 21, carrying an idle roller 26: on this latter acts a tooth 27 of an actuating cam 28 keyed to a control shaft 29 (FIG. 2), which shaft is longitudinally supported by the framing 10.

The thread-cutting unit 12 comprises a scissors unit formed by a movable blade 30 (FIGS. 2 and 3) and by a fixed counterblade 31, the latter being fastened to the framing 10. The movable blade 30 is pivoted at 32 to the fixed blade 31 and is connected to an actuating lever 33 through a link 34, the latter being pivoted at 35 and 36, to the movable blade 30 and the lever 33, respectively.

The lever 33, in its turn, is pivoted, at an intermediate point, by means of a pin 37 to a vertical supporting wall 38 which is transversally affixed to the framing 10 in the interior of same. Upon the end of the lever 33 away a spring 39 is active, which urges the lever 33 to be rotated about 37 in the anticlockwise direction as viewed along the arrow F in FIG. 2. In correspondence with said end, the lever 33 has, moreover, an upright 40 which carries an idle roller 41: on the latter a tooth 42 of a cam 43, keyed to the control shaft 29 adjacent to the cam 28, is active.

The second thread-seizing unit or pincer 13 is formed by a tubular guide 44 as supported, in a reciprocable manner along the arrow $F_1$ (FIG. 3), by means of a rod 45 which is guided to slide through bores 46 formed through header members 47 at the opposite ends of a rectilinear guide 48, the latter being pivoted at 54 to the supporting wall 38. The reciprocation of the rectilinear guide 48 is controlled by a cam 75 (FIG. 3) keyed to the shaft 29 and acting on an idle follower 76, the latter being carried by an upright 72 which is extended from the same guide 48. In the interior of the guide 44 there is controlled for vertical reciprocation the stem 49 of a movable foot 50. A spring 51, in a manner known per se, urges the foot 50 into engagement with a fixed abutment 52, the latter being fastened to the guide 44.

To the end for the stem 49 away of the foot 50 there is fastened, with a certain clearance, one end of a rod 53. On the opposite end of 53, which is shaped as in 55, acts the idle roller 56 of a resilient pawl 57 which is oscillated about a pin 58, the latter extending from the wall 38 (FIG. 3). The pawl 57 is fitted with a spring 59 which acts in the usual manner to have it rotated in the anticlockwise direction about 58 as viewed in FIG. 3 of the drawings. The rod 53, in an intermediate position of its, is linkably connected, by the agency of a link 60, to a slider 61 which slides within the guide 48. The link 60 is fastened to the rod 53 and is pivoted at 62 to the slider 61. In its turn, the slider 61, through a mechanism composed by a slot 64 and a slider 63 and a leverage 65, 66 and 67 (FIGS. 1, 2 and 3) is operatively connected to a control cam 68 keyed to the shaft 29. More exactly, the slider 63 (FIG. 3) is fastened to the lever 65 (FIG. 2) to be oscillated together with it, by a pin 69 passed through the wall 38. The lever 65, by the agency of the link 66, is linkably connected to the lever 67 which is pivoted at 70 to the wall 38. The link 66 at the points 8, 9 is pivoted to the lever 67 and the lever 65, respectively. The lever 67 in an intermediate point of its carries an idle follower 71 on which the active face 72 of the cam 68 is operative. As viewed in FIG. 3, the follower 71 has a rear extension 73 which is guided so as to slide within a vertical slot 74 as formed through the wall 38.

The thread-tucking unit 14 (FIGS. 1 and 4) comprises a hook needle 78 formed at the free end of an arm 79, the latter being slidable within end supporting members 80 of a guide 81 which is oscillably pivoted by a pin 82 to a sloping baseplate 83. The oscillation of the guide 81 about 82 is obtained by a cam 84 which is keyed to the shaft 29 and has an active face 85 in engagement with an idle roller 86 as carried by an arm 87. The latter arm is pivoted by the agency of a pin 88 to the framing 10. The arm 87 is connected by a link 89, linkably to an arm 90 which is integral with the guide 81.

Within the guide 81 there is controlled to slide a slider 91 which is affixed to the rod 79. The sliding motion of the slider 91 is carried out by a cam 93, the latter being keyed to the shaft 29 through a mechanism comprising a connecting rod 94 and a crank 95. The connecting rod 94 is fastened at either end, by a universal joint 96, to the top portion of the slider 91 and is pivoted at 97, at its opposite end, to either end of the crank 95: said crank has its opposite end pivoted, at 98, to a fork 99, the latter being fastened to the framing 10. The crank 95, at an intermediate position of its, carries an idle follower 100 on which the active face 101 of the cam 93 is operative.

The operation of the machine as described hereinabove is as follows:

In a manner which is well known to the technicians which are skilled in this particular field of the art, a waiting weft thread F wound from a spool in direction of the arrow FT is retained by the fixed pincer 11, presented by a presenter, taken up by the weft carrier and cut by a scissors upstream of the pincer 11. The presenter and carrier have not been indicated in that they are of a type well-known in this particular field of the art, while the scissors upstream of the pincer 11 has been omitted in the first form of embodiment (FIGS. 1–9), but is indicated with 121, 118 in the variant as per the FIGS. 10–13. The weft thread cut by this scissors is inserted by the carrier into the open warp shed S and beaten up by the reed P mounted on a sley (FIG. 9) in the fabric in formation (closure of the shed S); the reed P is moved into the forward position and simultaneously the movable pincer 13 advances and closes on the weft thread in the position of the FIGS. 1–6.

Figure 5:
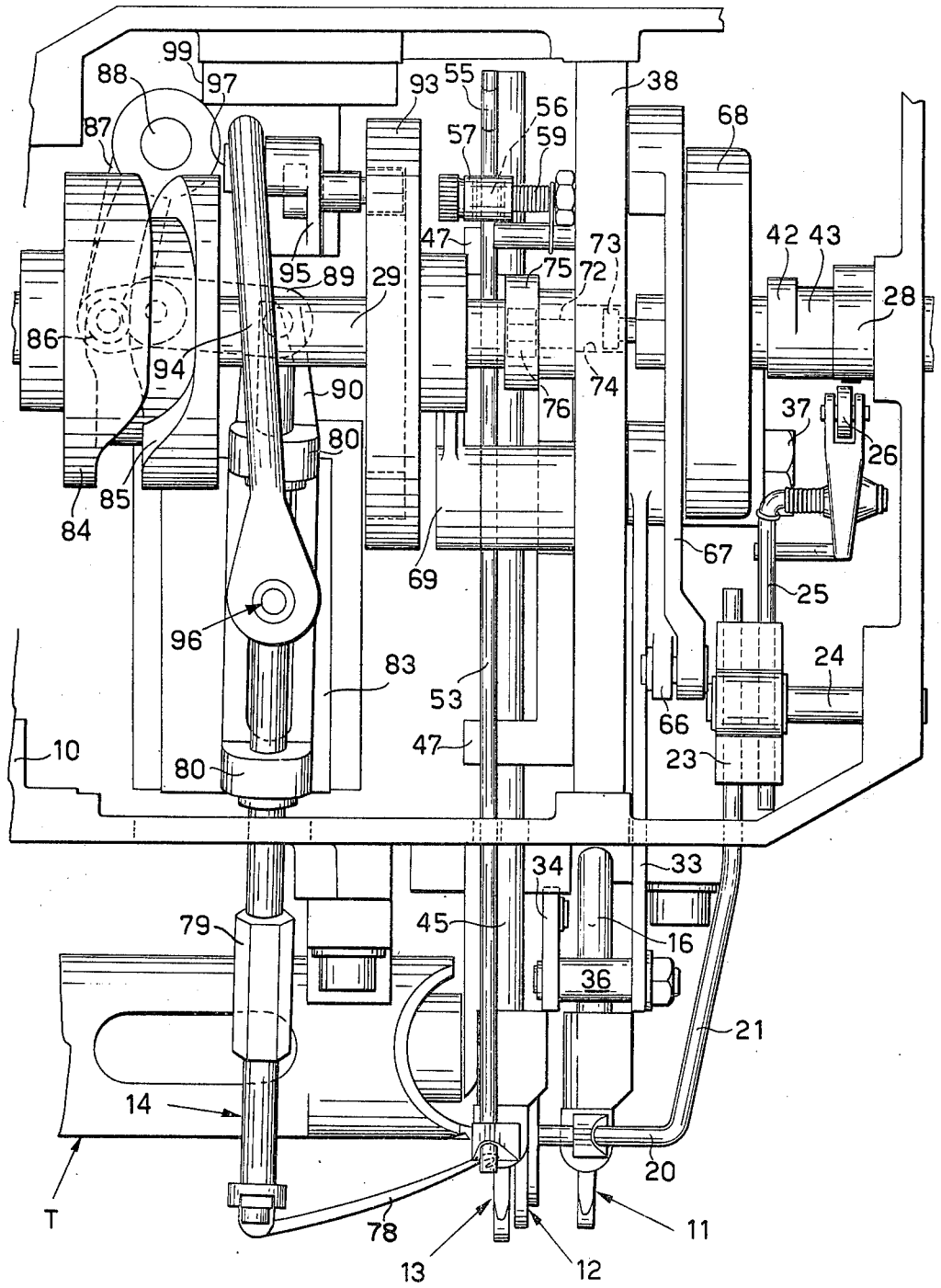
FIG. 5 is a plan view of the machine in a working condition other than that shown in FIG. 1.
Figure 6:
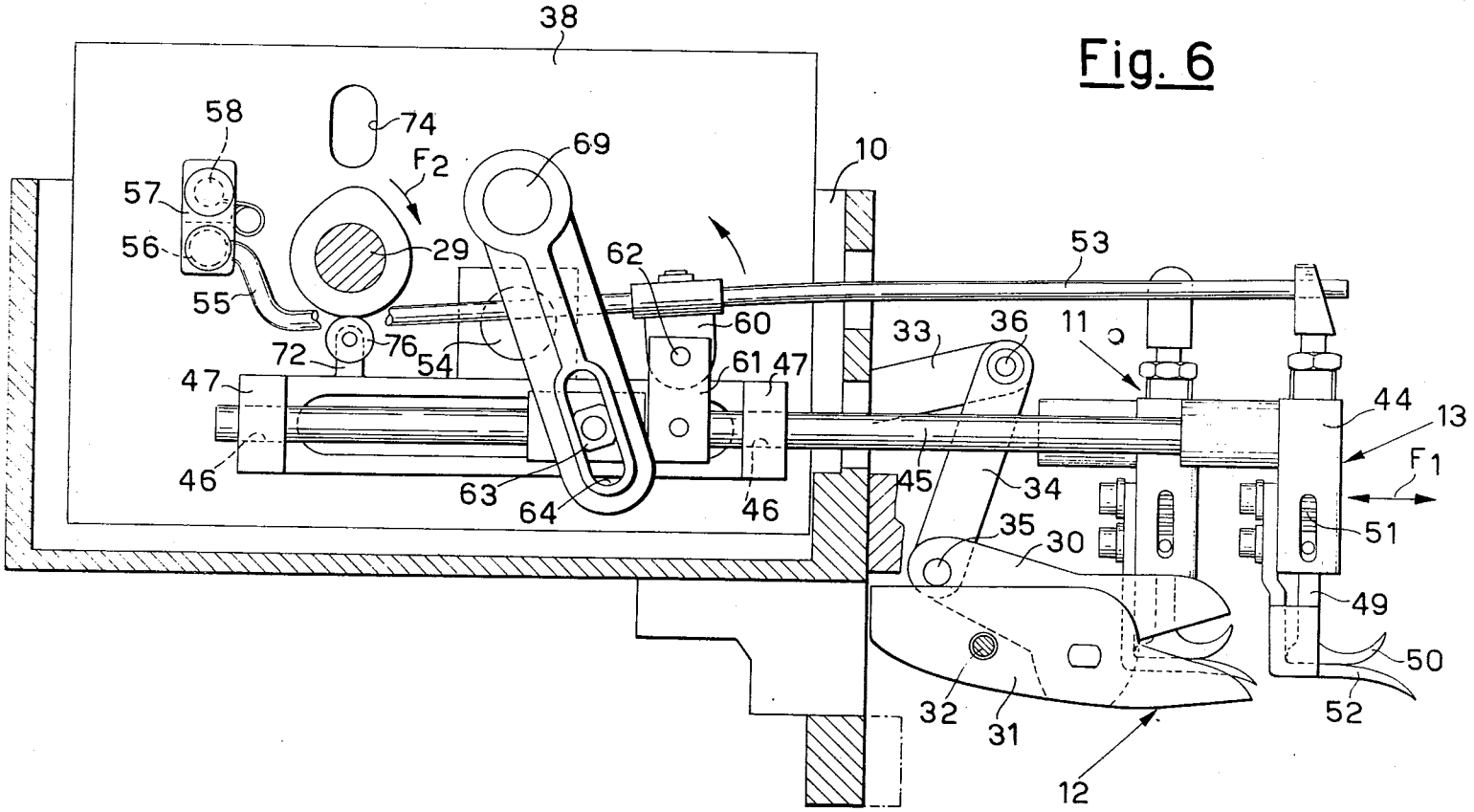
Figure 7:
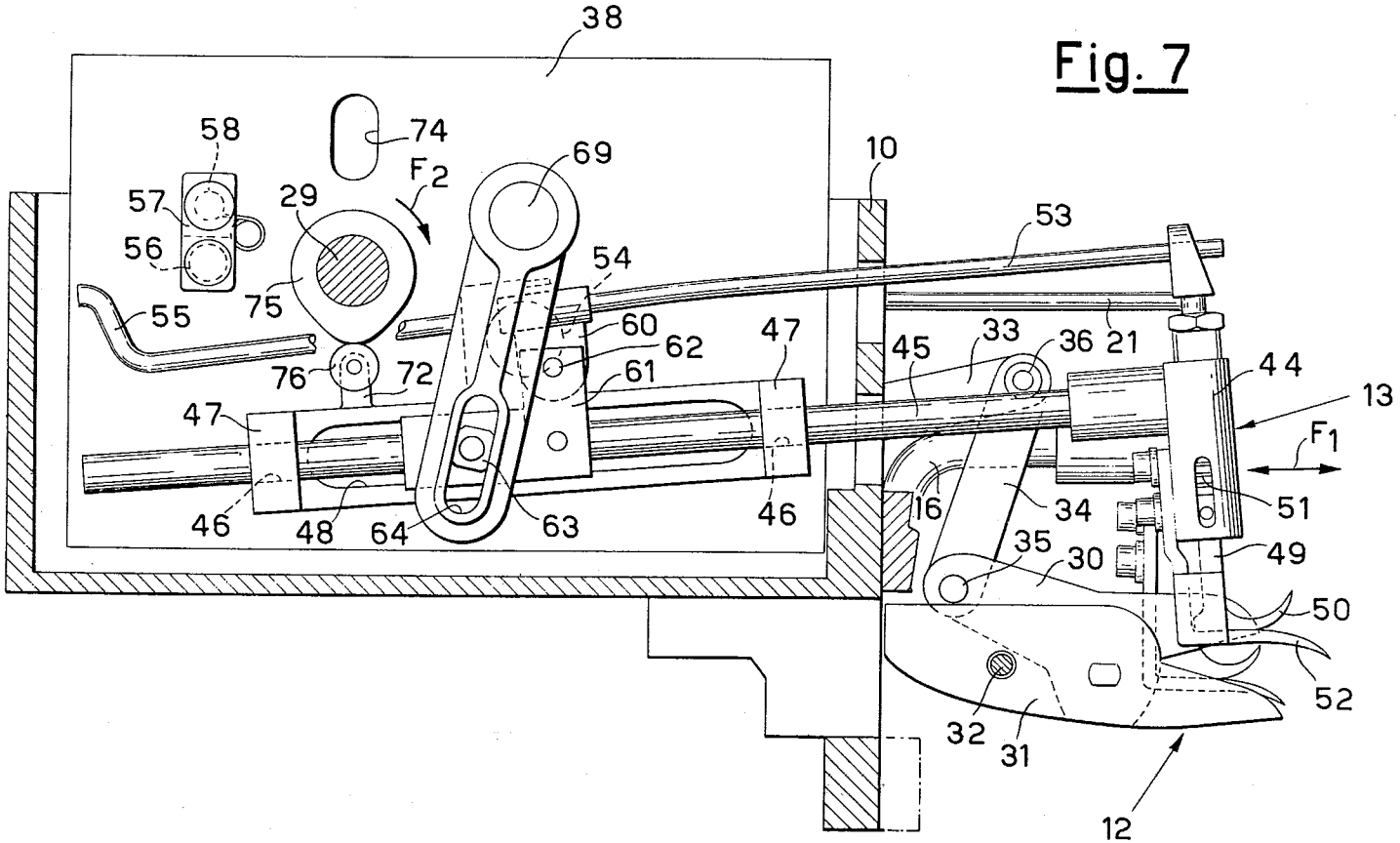

Assuming that the shaft 29 is continuously rotated in the direction as indicated by the arrow $F_2$ in FIG. 3, the weft thread F inserted in the open warp shed is first locked by the foot 50 which is depressed from the position of FIG. 3 to that of FIG. 6 against the abutment 52. The sudden and sequential lifting and depressing of the foot 50 is carried out by the rightward sliding motion of the rod 45 (FIG. 3) as caused by the cam 68 (FIG. 2), via the leverage 67, 66, 65, the slot-64-slider 63 assembly and the slider 61 fastened to the rod 45. Due to such displacement of the rod 45, the upward curled end of the rod 53 meets the follower 56 of the pawl 57, said pawl causing the rod 53 to be oscillated counterclockwise about 62. This rotation of the rod 53 causes the stem 49 to be slid upwards carrying its foot 50 to the lifted position of FIG. 3. As it continues its rightward run (as viewed in FIG. 3), the rod 45 leads the end 55 of the rod 53 to become clear of the action of the pawl 57 and consequently the spring 51 carries the foot 50 against the abutment 52 in the aforementioned position of FIGS. 6 and 7. The cam 68, while continuing its rotation, and via the mechanisms as disclosed hereinabove, causes a leftward shift of the rod 45 which is such as to bring the thread-seizing mechanism 13 to the position of FIG. 5, in alignment with the thread-seizing mechanism 11.

In this position the pincer 13 takes the weft thread below and slightly to the rear with respect to the needle 78 which has also meanwhile moved in the position of FIG. 5 from that of FIG. 1.

When the thread-seizing mechanism 13 is in the position of FIG. 5, the thread-seizing unit 11 is also closed onto the weft thread F. This takes place due to the engagement of the tooth 27 of the cam 28 with the follower 26 fastened to the rod 21. As a result, the rod 21 is led to be rotated about 24 clockwise so as to lift, via the stem 17, the foot 18, which is suddenly depressed to the position of FIGS. 2 and 6, by the bias of the spring 19, as soon as the tooth 27 overtakes the follower 26. A section of the weft thread F is thus pinched between the units 11 and 13.

Figure 8:
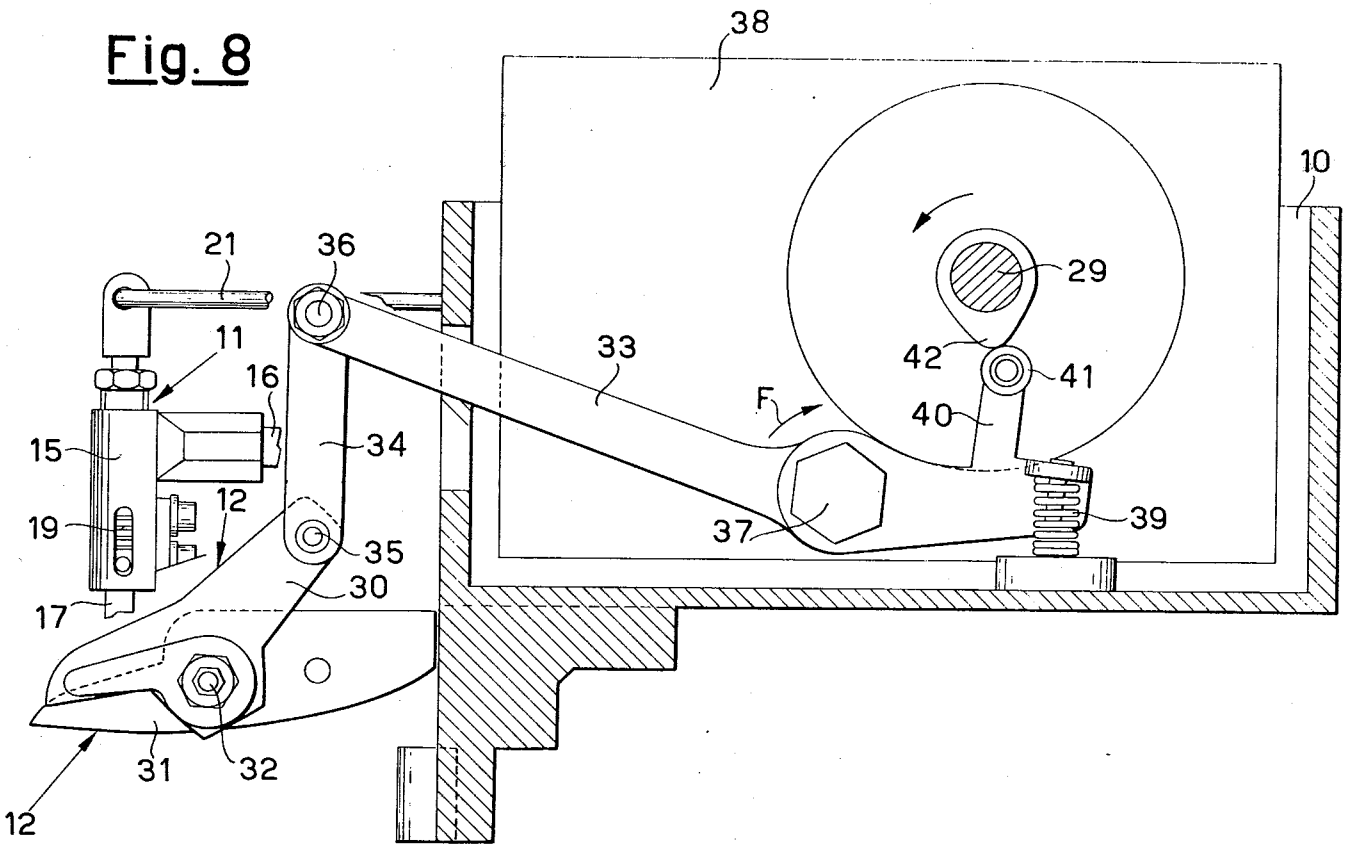

At this stage the thread-cutting device 12 enters action, which is positioned between the units 11 and 13 and which cuts the weft thread F. The movable blade 30 of the thread-cutting unit 12 is lowered by the agency of the tooth 42 of the cam 43 through the follower 41, the lever 33 and the link 34 (FIG. 8).

The cut end of the weft extending from the fabric is now held by the thread-seizing unit 13 only, while the end of the weft extending to the supply is held by unit 11 in a condition such as to be presented to the weft inserter for the next pick. The unit 13, holding the thread end to be tucked, owing to the continuous rotation of its control cam 68, from the position of FIG. 5 is first moved into the advanced position of FIG. 1, then returned to the retracted position of the FIGS. 4 and 5, passing through the lifted position of FIG. 7, owing to the oscillation about 54 in an anticlockwise direction of the guide 48, as originated by the action of the cam 75 upon the follower 76.

Concurrently with this return movement and upward shift of the thread-seizing unit 13, the hook needle 78 is led to be brought from the position of FIG. 5 on the side of the unit 13 to the position of FIG. 4 beneath the same device 13 and with the weft thread F thereover. This motion of the needle 78 is caused by the combined actions of the cams 93 and 84. The cam 93, through the connecting rod 94 and crank 95 assembly urges at the outset the arm 79 carrying the needle 78 to slide towards the right and to emerge at a position which is slightly advanced relative to that shown in FIG. 4. The cam 84, subsequently, through the linkage 86, 87, 88 and 90 compels the guide 81 and thus also the arm 79 to be rotated about 82 anticlockwise as shown by the arrow $F_3$ of FIG. 1 and simultaneously, still due to the action of the cam 93, the rod 79 is withdrawn so as to bring the hook needle 78 to the above mentioned position of FIG. 4.

At this stage, the thread-seizing device 13 is brought to the initial opened and withdrawn position of FIG. 2 and, simultaneously, the needle is brought from the position of FIG. 4 to the position of FIG. 9 in the interior of a slot 102 as formed through a conventional template T as used in shuttle-less weaving looms, passing through the position of FIG. 1. As a result, it is apparent that the end of the weft extending from the fabric, disengaged from the unit 13 is seized by the hook needle (FIG. 4) and introduced, after having been bent, into the open shed S which is closed immediately after so as to weave this portion of the weft thread and provide the tucked selvedge as symbolically shown at C in FIG. 1, where 0 indicates the warp threads.

The pincer 13 is withdrawn in order to permit, in the first place, the tucking into the shed of the end of the cut thread and then to permit the reed P to beat the weft thread subsequently inserted. The loss of the yarn at the moment of opening of the shed, after the beat up of the weft thread in the subsequent shed, is prevented, in a usual manner, either by false selvedges formed by a few warp threads at the side of the fabric or by retaining pincers.

The above described operative cycle is obviously reiterated as every weft thread is introduced. From the foregoing description it is apparent that the first thread-seizing unit is moved with a composite periodical motion on a plane which is substantially perpendicular to the direction of insertion of the weft in the warp, whereas the hook needle is moved on a plane which substantially coplanar with the fabric-formation plane, and also with a composite periodical motion. Obviously, when on a weaving loom a width of fabric is produced, there will be provided, laterally, two units as described above for the formation of relative tucked selvedges at the two sides of said fabric.

Clearly, the needles 78 of the two devices will operate counterwise, because the opposite ends of the weft thread must have tucked into the warp shed folding them back respectively from right to left and from left to right. Furthermore, the device on the side of the loom remote from the weft inserting side is not provided with the unit 11, but it is only provided with the units 12 and 13.

Conversely, in the case of the formation of more than one width of fabric on a single weaving loom, machines according to the invention are also mounted centrally of said loom.

Also, the machines mounted at the center of the loom are not provided with the units 11, but are only provided with the units 12 and 13.

It is extremely important to note that this is possible without it being necessary to from openings through the reed P (FIG. 9) of the loom, contrary to what is conventionally essential to do with the conventional implementations as used today.

This is so because the thread-pinching device according to the invention takes the wefts when the reed P is in the forward position, that is, away of the template and positions the wefts in such a way that the needles can grasp each thread and introduce same, bent, in the warp, to enter the slot 102 again in a position flush with the template when the reed P is in retracted position at the position of FIG. 9. It should be noted, moreover, that it is advisable that also the pincers 13, when the reed is in retracted position, be flush with the template T, that is, not advanced relative thereto. This can easily be obtained by adjusting the length of the rod which carries the pincers 13.

By so doing, there is no working interference whatsoever between the apparatus for forming the selvedge and the loom reed, contrary to what occurs in the conventional machines wherein the reed, as it is being in retracted position, brings the weft thread into the pincers which, consequently, must be located, of necessity, on a plane which is advanced relative to the template plane.

Consequently, with the apparatus according to the invention, the same reed can be employed for introducing on a single loom more fabrics having different widths.

According to a further embodiment of the invention, as shown in FIGS. 10–13, the pincers 11 can advantageously be replaced by a unit 110 which, in addition to the pincers which is intended to hold the weft threads, also comprises a cutting device which is intended to sever the weft thread which is on the point of being inserted into the warp shed.

More detailedly, the unit 110 is structurally composed by a bracket 111 affixed by a bolt 112 to a fixed portion 113 of the loom. To the bracket 111 is affixed, by two pins 114, 115, an arm 116 which carries a detent tooth 109, a fixed jaw 117 and a fixed counterblade 118. Between the bracket 111 and the arm 116, to the pin 115, there is oscillably pivoted an arm 119 carrying a movable jaw 120 and a blade 121. The jaw 120 is mounted at the end of two rods 122 with heads 123 and slidable within bores 124 of a supporting member 125 which is integral with the arm 119.

Between the supporting member 125 and the jaw 120 two shock-absorbing springs 126 are active, which are inserted on the rods 122, respectively. The jaws 117 and 120 form the so-called thread-grasping pincers and the blade and the counterblade form, together, an additional thread-cutting device.

The operation of the above described unit is, briefly outlined, as follows.

The weft thread F which is awaiting is clasped between the jaws 117 and 120 of the pincers as the arm 119 has been swung in the clockwise direction from the position of the FIGS. 10 and 11 to the position of FIG. 12. The weft F is presented by the weft presented which, by shifting it, as usual, forwards in the travel of the carrier and by effect of the tooth 109 stretches it and disposes it at the correct angle, thus ensuring that the carrier takes it reliably (FIG. 12). The arm 119 then continues its oscillation in the clockwise direction until reaching the position of FIG. 13, wherein the blade 121 by cooperating with the counterblade 118 severs the weft thread F which, by the weft carrier is inserted in the warp shed. The arm 119 is then restored to the lifted position of FIGS. 10 and 11 and the device is in readiness for receiving another weft thread.

The clockwise and anticlockwise oscillation of the arm 119 can advantageously be controlled by the cam system as disclosed hereinabove and operatively connected to the end 127 of said arm 119.

Then, the variant of the invention illustrated in the FIGURES from 10 to 13 consists in having incorporated into the fixed pincer 11 the scissors (121, 118), which actuates the first cut of the weft thread (scissors not shown in the previous embodiment) in order to allow the carrier to insert the said thread into the open warp shed. It also consists in providing the retaining tooth (109) which serves to maintain the weft thread at the correct angle and at the correct tension when the presenter presents it so as to be taken securely by the carrier and severed by the scissors 121, 118. If the tooth 109 were not present, the section of weft thread extending between the closed jaws 117 and 120 and the presenter in advanced position, when seized by the carrier which inserts the weft thread into the shed, could be angled by the said carrier in such a position as not to be cut by the scissors 121, 118.

From what has been set out above it appears clear how the blade 121 cuts the weft thread upstream of the device 11, i.e. to the right of this latter looking at the drawing.

The reason for the two cuts (scissors 121, 12) has already been explained in indirect manner above. The first cut by the blade 121 takes place in order to allow the carrier to insert the weft thread into the warp shed; whereas the second cut by the scissors 12 takes place to allow the tucking of the extremity of the thread into the warp shed for the formation of the tucked-selvedge. The tail that remains between 12 and 117–120 is lost, or else goes to make up the possible false selvedge mentioned above consisting of a few warp threads. It is evident that, having two devices at the sides of the loom and having to form two tucked-selvedges, at the sides of the fabric both the extremities of the inserted weft thread are gripped by the respective pincers of each device.

While the invention has been described with particular reference to a few preferred embodiments thereof, it will be understood that modifications and changes can be introduced therein without departing from the scope of the invention as defined in and by the appended claims.

For example, in the case where there are weft threads of different colours, there will be provided as many thread-seizing devices or pincers 11 as there are weft threads.

It should also be noted that, if necessity demands, both the pincers can be provided movable.

What I claim is:

1. A machine for the formation of tucked-selvedges in fabrics formed with warp and weft threads by means of a shuttle-less loom, wherein said machine comprises, in combination:

(a) a thread-seizing device movable between an advanced position in which it closes on the extremity of the last weft thread inserted extending outside the warp shed and a retracted position in which it takes said extremity of the weft to engage with a stationary thread-seizing device positioned laterally with respect to the thread-seizing, so that a section of said weft thread extremity is pinched between the thread-seizing devices;

(b) a scissors positioned between the thread-seizing devices and actuable so as to cut said section of weft extending between the thread-seizing devices;

(c) first actuating means cooperating with the thread-seizing device in order to return it, with the weft thread extremity extending from the warp and just cut by the scissors, to the aforesaid advanced position and then again to retracted position passing through a raised position;

(d) a hook needle movable from a position within a seating of the template of the loom above the fabric being formed, through a succeeding warp shed, to a position protruding from the said warp shed below the thread-seizing device to be returned to the retracted position gripping the extremity of the weft extending from the shed and previously cut by the scissors, so that said extremity of the weft is released by the thread-seizing device and is seized by the hook needle which, returning within the seating in the template inserts it folded into the shed which closes to form on the fabric the tucked-selvedge; and (e) with the aforesaid first actuating means adapted to move in a correct operating sequence the movable thread-seizing device cooperating additional actuating means adapted to open and close the stationary thread-seizing device and the scissors and to move the hook needle in a correct operating sequence.

2. A machine according to claim 1, wherein said movable thread-seizing device is moved with a composite periodical motion on a plane which is substantially perpendicular to the direction of tucking said extremity of the weft extending outside the shed.

3. A machine according to claim 1, wherein said first and additional actuating means comprise a cam set with cams which are keyed onto a common driving shaft and operatively interconnected with said thread-seizing devices, said thread-cutting device and said hook needle through articulated links.

* * * * *